United States Patent [19]

Bergee et al.

[11] 4,081,865

[45] Apr. 4, 1978

[54] PROTECTIVE HELMET AND VENTILATING SYSTEM THEREFOR

[76] Inventors: Mark A. Bergee, 5808 Ashcroft Ave., Edina, Minn. 55424; William K. Gilchrist, 5545 Warden Ave., Edina, Minn. 55436

[21] Appl. No.: 814,106

[22] Filed: Jul. 8, 1977

[51] Int. Cl.[2] ..... A63B 71/10

[52] U.S. Cl. ..... 2/425; 2/412; 2/414

[58] Field of Search ..... 2/425, 410, 411, 412, 2/414, 6, 421

[56] References Cited

U.S. PATENT DOCUMENTS

| | | | |
|---|---|---|---|
| 3,116,490 | 1/1964 | Zbikowski | 2/414 |
| 3,344,433 | 10/1967 | Stapenhill | 2/420 |
| 3,496,854 | 2/1970 | Feldman et al. | 2/410 X |
| 3,783,450 | 1/1974 | O'Connor | 2/421 |
| 3,925,821 | 12/1975 | Lewicki | 2/425 |

FOREIGN PATENT DOCUMENTS

| | | | |
|---|---|---|---|
| 1,456,824 | 11/1976 | United Kingdom | 2/410 |

*Primary Examiner*—Alfred R. Guest

*Attorney, Agent, or Firm*—Merchant, Gould, Smith, Edell, Welter & Schmidt

[57] ABSTRACT

A protective head gear or helmet having a ventilating system for cooling the interior of the helmet. Air inlet and outlet openings in the front and neck portions respectively of the helmet and air passages connected to the openings communicate with the interior of the helmet by means of apertures extending between the helmet interior and the air passages. Flow of air through the interior of the helmet, caused by relatively high pressure at the inlet openings and relatively low pressure or suction at the outlet openings during forward movement of the wearer when operating a vehicle, is controlled by valve mechanism operated from the exterior of the helmet.

10 Claims, 8 Drawing Figures

PROTECTIVE HELMET AND VENTILATING SYSTEM THEREFOR

BACKGROUND OF THE INVENTION

This invention relates generally to improvements in protective head gear or helmets, and more particularly to the type of helmets presently used by motorcyclists. These usually include an outer shell of impact resistant material, a relatively thick liner of cushioning material within the shell, a relatively thin inner cover of soft sheet material, and an interior cushioning pad fastened to the inner cover and closely fitting the head of the wearer, leaving small air spaces between the wearer's head and the inner cover. In warm weather, these helmets become quite uncomfortable due to the fact that only the wearer's face and throat are exposed to the exterior air and then only when certain types of face shields or no face shields at all are used. An important object of this invention is, therefore, the provision of an improved safety helmet having a ventilating system which will supply a gentle flow of air through the interior of the helmet, and means for controlling the flow of air therethrough.

SUMMARY OF THE INVENTION

The safety helmet of this invention involves a rigid outer protective shell, a relatively thick liner of cushioning material, a relatively thin inner cover on said liner, said shell, liner and inner cover defining crown, front, side and neck portions. A cushioning pad extends circumferentially about the interior of said inner cover and is secured thereto. Said inner cover and liner cooperate to define a circumferentially extending passage means around said front, side and neck portions. Said inner cover defines a plurality of apertures extending between said passage means and the interior of the helmet. Air inlet opening means are disposed in said front portion of the shell and liner, and air outlet opening means are disposed in said neck portion of the shell and liner for communication with said passage means; and valve means are provided for controlling movement of air through said inlet and outlet openings, passage means, and apertures.

DETAILED DESCRIPTION OF THE PREFERRED EMBODIMENT

Figure 1:
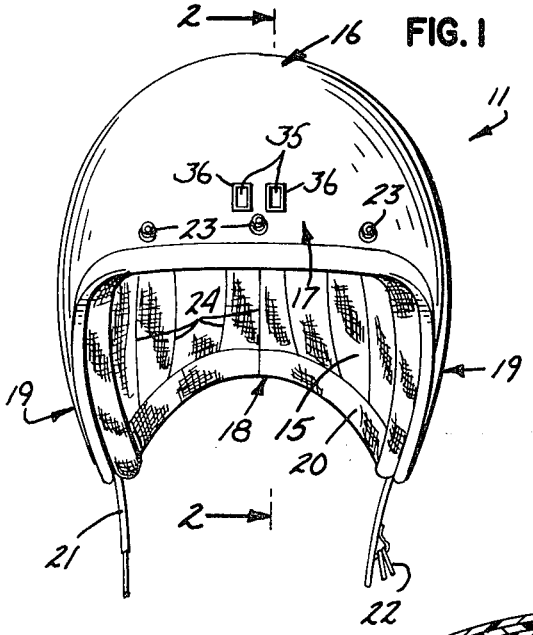
FIG. 1 is a view in front elevation of a helmet showing air inlet openings of this invention.

A protective head gear or helmet, intended primarily for use by operators of vehicles such as motorcycles, is indicated generally at 11, the same comprising a rigid outer protective shell 12, a relatively thick liner 13 of suitable cushioning material, a relatively thin inner cover 14 covering the interior of the liner 13, and a cushioning pad 15 within the inner cover 14. The shell 12, liner 13 and inner cover 14 define a crown portion 16, a front portion 17, a neck portion 18, and opposite side portions 19. The marginal edge of the helmet 11 is padded in part by the cushioning pad 15, and by a marginal pad portion 20. As shown in FIG. 1, the helmet is provided with fastening straps 21 and 22 for securing the helmet to the head of a wearer, and conventional snap buttons 23 for securing the usual transparent face plate, not shown, to the helmet 11. As shown particularly in FIG. 4, the cushioning pad 15 is secured by stitching or the like at circumferentially spaced intervals to the inner cover 14, as indicated at 24, leaving small spaces between the cushioning pad 15 and inner cover 14. The crown portion 16 of the helmet is further provided with a dished porous pad 25 secured to an arcuate mounting band 26, see FIG. 2.

Figure 3:
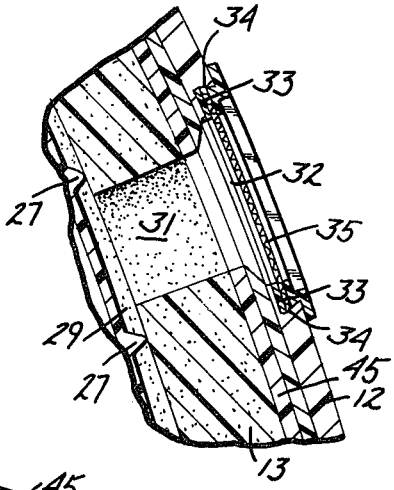
FIG. 3 is a further enlarged detail of the air inlet portion shown in FIG. 2.
Figure 4:
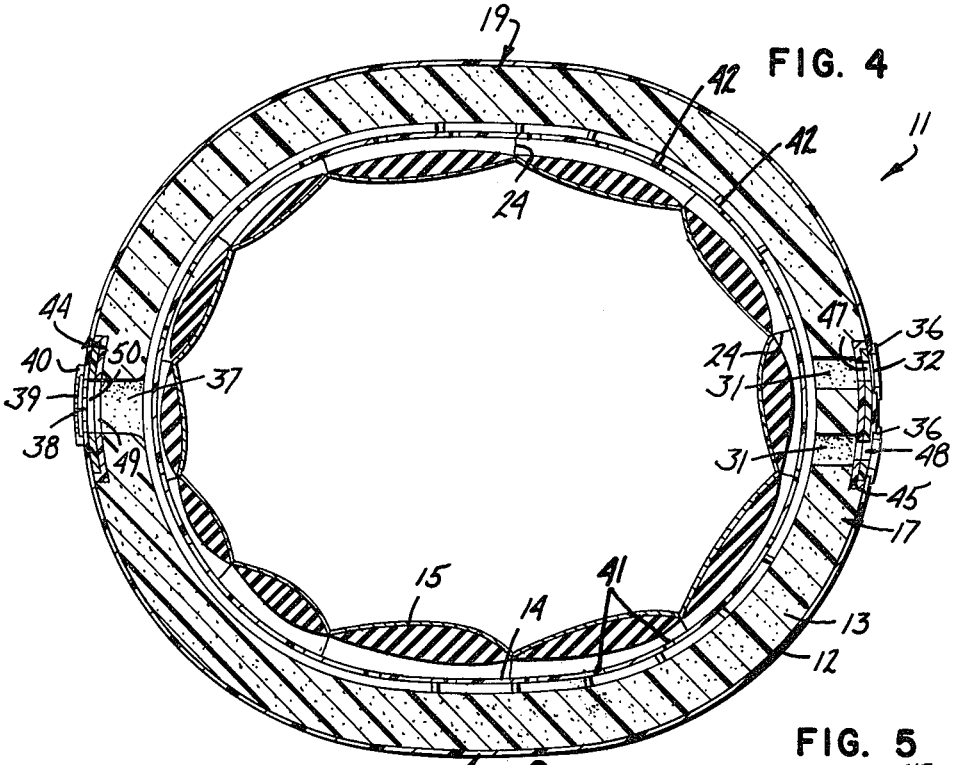
FIG. 4 is a view in cross section, taken generally on the line 4—4 of FIG. 2.

The helmet 11, as thus far described, is of the type generally used by operators and riders of motorcycles and similar vehicles. The preferred type of helmets are provided in sizes similar to hat sizes, and, being rather snug fitting on the heads of the rider, often become uncomfortably warm in hot summer weather due to lack of ventilation within the helmet. In accordance with the present invention, the inner cover 14 is formed with spaced ridges 27 and 28, the ridges 27 cooperating to define a circumferentially extended air passageway 29, the ridges 28 cooperating to define a branch passageway 30, the passageways 29 and 30 being disposed between the liner 13 and inner cover 14, the branch passageway 30 extending from the passageway 29 to the crown portion 16 of the helmet 11. Air inlet opening means to the passageway 29 includes a pair of laterally spaced air passages 31 through the liner 13, communicating at one end with the passageway 29, and a pair of inlet air openings 32 through the outer shell 12 outwardly of respective ones of the air passages 31. As shown, the air inlet openings 32 are generally rectangular in form, and include outer recess portions which define peripheral shoulders 33 and outwardly converging the side portions 34, see particularly FIG. 3. Screens or like porous filter elements are indicated at 35, and overlie the air inlet openings 32 and have their peripheral portions seated on the shoulders 33. Generally rectangular retainer frames 36 are snap fitted into the outer portions of the air inlet openings 32 and engage the side portions 34 of the openings 32 to releasably hold the filter elements 32 in place. As shown in FIGS. 1 and 4, the air inlet openings with their filter elements and retainer frames 35 and 36 respectively are disposed in laterally spaced relationship on the front portion 17 of the helmet 11, otherwise known as the brow portion of the helmet.

Figure 2:
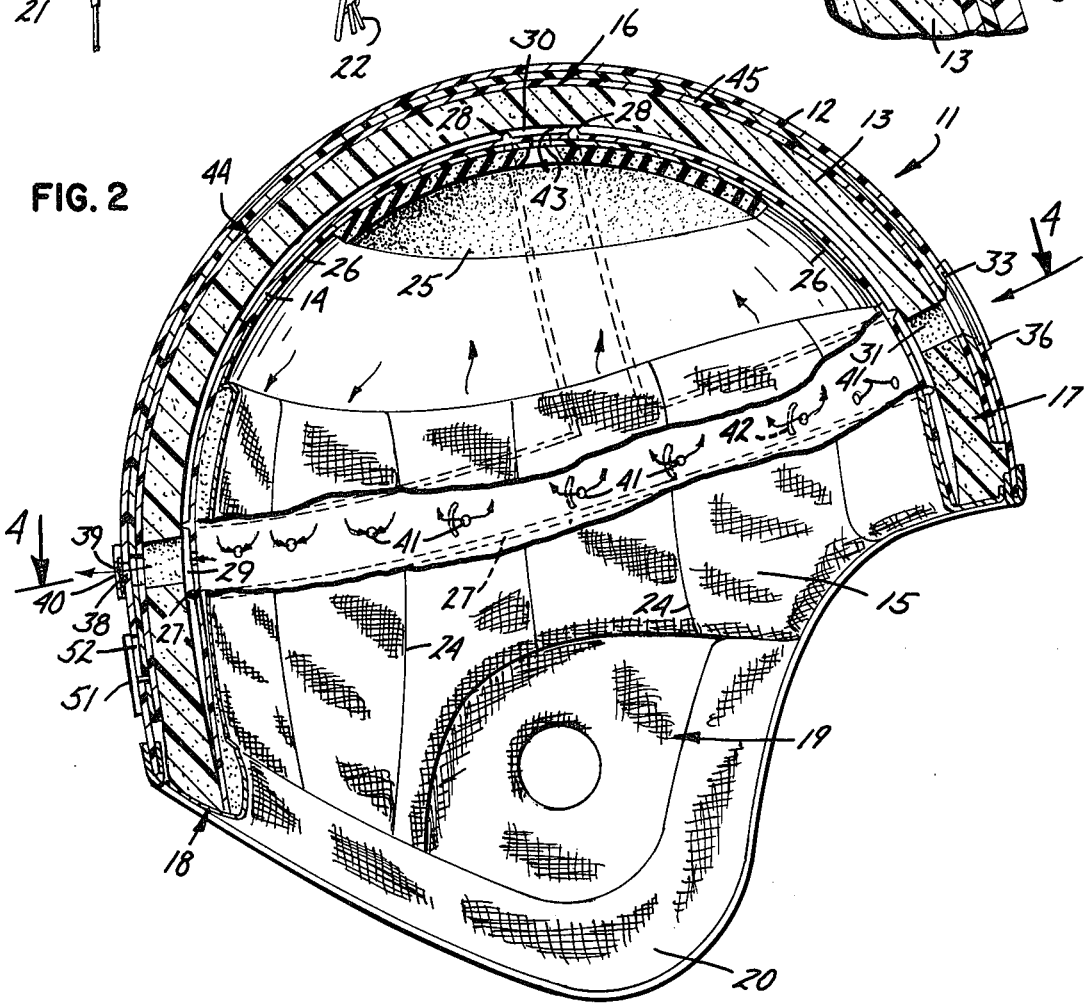
FIG. 2 is an enlarged transverse section of the helmet taken generally on the line 2—2 of FIG. 1.

At the rear or neck portion 18 of the helmet 11, an air outlet passage 37 communicates at one end with the circumferentially extended passageway 29, and at its other end is adapted to communicate with an air outlet opening 38 in the neck portion of the outer shell 12. The air outlet opening 38 is similar to the air inlet opening 32, and is provided with a filter element 39 and a retainer frame 40 similar to the filter elements 35 and retainer frames 36. As shown in FIGS. 2 and 4, the inner cover 14 is provided with a plurality of circumferentially spaced apertures 41 that extend transversely therethrough and which communicate with the passageway 29 and the spaces between the inner cover 14 and cushioning pad 15. At the front and side portions, the inner cover 14 is formed to provide scoop-like baffles 42 which direct air entering the passageway 29 from the front air openings in the helmet, through the apertures 41 to the interior of the helmet. At the crown portion 16, the inner cover 14 is provided with an aperture 43 for directing air from the branch passage 30 into the interior of the helmet 11 through the cushioning pad 25 thereof. As air moves into the interior of the helmet through the apertures 41 provided with baffles 42, and through the aperture 43, it circulates around the interior of the helmet 11 and outwardly through the rearwardly disposed apertures 41, outlet passage 37 and air outlet opening 38.

Figure 5:
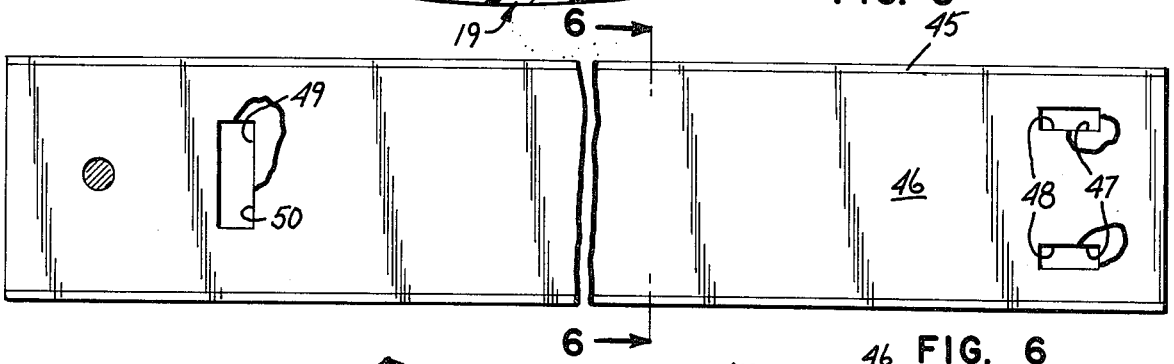
FIG. 5 is a fragmentary flattened-out view of the valving portion for the air inlet and outlet openings of the helmet.
Figure 6:
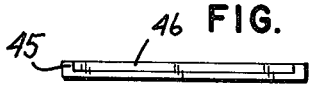
FIG. 6 is a transverse section taken on the line 6—6 of FIG. 5.

For the purpose of controlling flow of ventilating air through the interior of the helmet 11, the liner 13 is formed to provide a channel 44 extending from the front or brow portion 17, over the crown portion 16 and to the lower end portion of the neck portion 18 for reception of control means including a channel-like guide member 45 and an elongated slide valve member 46 longitudinally slidably received in the guide member 45. As shown particularly in FIG. 5, the guide and slide valve members 45 and 46 have pairs of inlet openings 47 and 48 respectively adjacent one end thereof, the openings 48 moving into and out of register with the openings 47 responsive to longitudinal sliding movement of the slide valve member 46. Adjacent their opposite end, the members 45 and 46 are provided with respective air outlet openings 49 and 50, the opening 50 moving into and out of register with the opening 49 at the same time that the openings 48 move into and out of register respectively with the openings 47. The guide member 45 is mounted in the channel 44 so as to be snugly held therein against longitudinal movement, and, in the embodiment illustrated, the slide valve member 46 is provided with a knob 51 that extends outwardly through a slot 52 in the outer shell 12 at the neck portion 18, so that the slide valve member may be moved between valve opened and valve closed positions in the guide member 45. The guide member 45 and slide valve member 46 may be made from any suitable flexible material having relatively low coefficients of friction, so that the slide valve member 46 may be easily moved between its valve opened and valve closed positions. With reference to FIG. 3, it will be noted that the air inlet openings 47, one of which is therein shown, have tapered sides or ends to funnel incoming air into the openings 48 and air passages 31. Preferably, the control knob 51 is shown as being disposed at the end of the slide valve member 46 adjacent the neck portion of the helmet 11. It will be appreciated that with some helmets the knob 51 might be disposed at the opposite end portion of the slide valve member 46, so as to be located at the brow portion 17 of the helmet, if desired. Further, though not shown, it will be appreciated that both ends of the slide valve member 46 may be provided with control knobs 51, so that the slide valve member 46 may be moved selectively from either end.

MODIFICATION OF FIGS. 7 AND 8

Figure 7:
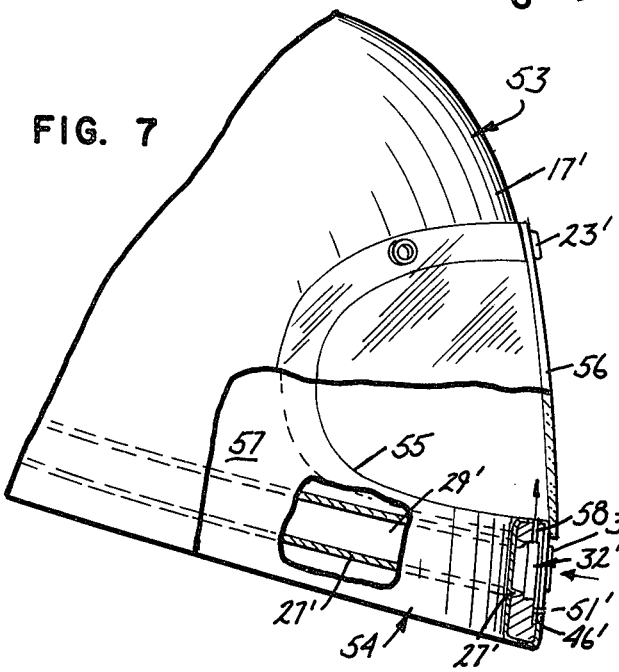
FIG. 7 is a fragmentary view in side elevation of a modified form of helmet, some parts being broken away and some parts being shown in section.
Figure 8:
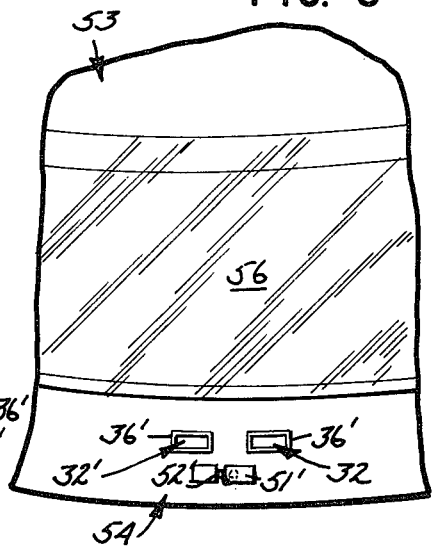
FIG. 8 is a fragmentary view in front elevation of the helmet of FIG. 7.

In FIGS. 7 and 8, a protective helmet is fragmentarily shown and indicated generally at 53, the same being constructed in a manner similar to the helmet 11 but differing therefrom in including a chin protecting portion 54 that is disposed forwardly of the chin of a wearer when in use. The helmet 53 defines a front opening 55 that is normally covered by a transparent protective shield 56 removably secured to the brow portion 17' by conventional snap fasteners 23'.

The inner cover 57 of the helmet 53 has spaced ridges 27' which define a passageway 29' similar to the passageway 29 that communicates with a pair of air inlet openings 32' in the chin protecting portion 54, these being provided with filter equipped retainer frames 36' similar to the retainer frames 36 and retainer member 40. It may be assumed that the air passageway 29' delivers air to the interior of the helmet 53 in the same manner as does the air passageway 29. Movement of air from the air inlet openings 32' and air passageway 29' is controlled by a slide valve member 46', similar to the slide valve member 46 and provided with a control knob 51', working in a slot 52' in the chin protecting portion 54. One or more air passages 58 extends from the air inlet openings 32 upwardly through the chin protecting portion 54 to the interior of the helmet 53 behind the shield 56 thereof. This arrangement not only provides for a gentle flow of air to the face portion of the wearer, but also prevents fogging of the shield 56. It will be noted that the control knob 51 is of a size and shape to completely cover the slot 52' in all positions of the knob 51'. With this arrangement, the slot 52' is protected from foreign matter. It will be further noted that the knob 51 is also of a size and shape to fully cover the slot 52 in the same manner.

While the inner cover 14 is shown and described as being provided with the ribs 27 and 28, it will be appreciated that these ribs may, if desired, be formed integrally with the liner 13, or affixed thereto, if desired.

While several embodiments of ventilating systems for protective helmets are disclosed, it will be understood that the same is capable of further modification without departure from the spirit and scope of the invention, as defined in the claims.

What is claimed is:

1. A protective helmet comprising a rigid outer protective shell, a relatively thick liner of cushioning material, a relatively thin inner cover on said liner, said shell, liner and inner cover defining crown, front, side and neck portions; a cushioning pad extending circumferentially about the interior of said inner cover and secured thereto; said inner cover and liner cooperating to define a circumferentially extending passage means around said front, side and neck portions; said inner cover defining a plurality of apertures extending between said passage means and the interior of the helmet; air inlet opening means in said front portion of the shell and liner and air outlet opening means in said neck portion of the shell and liner for communication with said passage means; and valve means for controlling movement of air through said inlet and outlet openings, passage means, and apertures.

2. The protective helmet defined in claim 1 in which said cushioning pad is secured to said inner cover at circumferentially spaced points to provide spaces between said pad and inner cover, said apertures opening to the interior of the helmet in said spaces.

3. The protective helmet defined in claim 1 in which said valve means comprises a valve member slidably disposed between said shell and inner cover, and a valve actuator on the exterior of said shell for moving said valve member between valve open and valve closed positions relative to at least one of the air opening means in said shell.

4. The protective helmet defined in claim 3 in which said valve member is slidably disposed between said shell and said liner and having an air opening therethrough movable into and out of register with at least one of said air opening means in said shell.

5. The protective helmet defined in claim 1 in which said shell and liner cooperate to define a channel extending from said front portion over said crown portion to said neck portion, said valve means comprising a guide member in said channel and an elongated flexible member longitudinally slidable in said guide member, said valve and guide members having opposite end portions disposed at said front and neck portions and having apertures therethrough at said front and neck portions, the apertures in said valve member being movable into and out of register with respective ones of said air inlet and outlet opening means and corresponding ones of the apertures in said guide member.

6. The protective helmet defined in claim 5 in which said front portion of said shell includes a brow portion disposed over the forehead of a wearer in use, said air inlet opening means comprising a pair of laterally spaced openings in said brow portion of the shell.

7. The protective helmet defined in claim 1 in which said front portion of the shell, liner and inner cover includes a chin protecting portion disposed forwardly of the chin of a wearer in use, said air inlet opening means comprising a pair of laterally spaced air inlet openings in said chin protecting portion.

8. The protective helmet defined in claim 7 in which said valve means comprises a slide valve member disposed in said chin protecting portion and having at least one opening therein movable into and out of register with said air inlet openings in the chin protecting portion.

9. The protective helmet defined in claim 1 in which said air inlet opening means comprises at least one air inlet opening, said outer shell defining a recess providing a shoulder around said air inlet opening, characterized by an air filter element overlying said opening and having a peripheral portion engaging said shoulder, and a retainer frame removably fitted in said recess outwardly of said filter element.

10. The protective helmet defined in claim 1 in which said passage means includes a branch passage extending to the crown portion of said liner and inner cover, characterized by at least one aperture extending from said branch passage to the interior of the helmet at said crown portion.

* * * * *